US009488375B2

(12) United States Patent
Marcakis

(10) Patent No.: US 9,488,375 B2
(45) Date of Patent: Nov. 8, 2016

(54) ADJUSTABLE CIRCULATING CHAMBER FOR FIRE INSERTS

(71) Applicant: Emmanuel Marcakis, Montreal (CA)

(72) Inventor: Emmanuel Marcakis, Montreal (CA)

( * ) Notice: Subject to any disclaimer, the term of this patent is extended or adjusted under 35 U.S.C. 154(b) by 399 days.

(21) Appl. No.: 14/225,676

(22) Filed: Mar. 26, 2014

(65) Prior Publication Data

US 2015/0276227 A1 Oct. 1, 2015

(51) Int. Cl.
*F24B 1/189* (2006.01)
*F24B 13/02* (2006.01)

(52) U.S. Cl.
CPC ..... *F24B 1/189* (2013.01); *F24B 13/02* (2013.01)

(58) Field of Classification Search
CPC ..... F24B 1/189; F24B 1/191; F24B 1/195; F24B 1/1957; F24B 13/02
See application file for complete search history.

(56) References Cited

U.S. PATENT DOCUMENTS 438,732 A 10/1890 Keifel, Jr
957,642 A 5/1910 Barker
1,001,383 A 8/1911 Geer et al.
1,404,808 A 1/1922 Taylor
1,516,169 A 11/1924 Wilkinson et al.
1,587,227 A 6/1926 Hallberg
1,773,858 A * 8/1930 Radford ..... F24B 1/1885 126/528
1,858,967 A * 5/1932 Pettiegrew ..... F24B 1/195 126/500
2,563,078 A 8/1951 Silberman
2,582,373 A 1/1952 Cordrey
3,368,732 A * 2/1968 Kimble ..... F24C 15/007 126/39 M
3,880,139 A 4/1975 Young
3,994,275 A * 11/1976 Williams ..... F24C 15/22 126/274
4,194,490 A * 3/1980 Crnkovic ..... F24B 1/1957 126/39 M
4,224,921 A * 9/1980 Petrescue ..... F24B 1/1885 126/518
D261,600 S 11/1981 Langtry et al.
4,603,682 A * 8/1986 Maziasz ..... F24B 1/195 126/319
4,700,687 A * 10/1987 Bailey ..... F24B 1/1806 126/500
4,898,154 A * 2/1990 Richison ..... F24B 1/1806 126/307 R
4,924,850 A 5/1990 Rieger
5,010,874 A * 4/1991 Toth ..... F24B 1/193 126/243
5,664,556 A * 9/1997 Byers ..... F24C 15/22 126/500
5,782,231 A * 7/1998 Wade ..... F24B 1/1808 126/200
5,901,701 A 5/1999 Wade
5,934,268 A 8/1999 Onocki
7,011,424 B1 * 3/2006 Poulson ..... F21S 13/00 362/161
7,784,458 B2 * 8/2010 Richter ..... F23J 13/04 126/301
D655,132 S 3/2012 Chowning

FOREIGN PATENT DOCUMENTS

FR 2414171 A1 * 8/1979 ..... E04F 19/005
GB 2519366 * 4/2016

* cited by examiner

*Primary Examiner* — Christopher Harmon

(57) ABSTRACT

An adjustable circulating chamber for a fireplace insert having a rear wall including two linear sets of perforations forming two bendable side walls, and adapted such that the chamber can be adjusted to fit within fireplace inserts of differing dimensions and a top member including a linear set of perforations forming a flange portion thereon. The flange portion is adapted to be adjustably attached to the rear wall to thereby provide means to vary the height of the top member with respect to the rear wall. The top member further includes an oval-shaped opening therethrough and an adjustable flange member slidably mounted thereto and over the oval-shaped opening and having a circular opening therethrough, such that the oval-shaped opening and the adjustable flange member working together are adapted to receive, adjust, and fit fireplace flue pipes of differing dimensions to the fireplace insert.

6 Claims, 3 Drawing Sheets

ADJUSTABLE CIRCULATING CHAMBER FOR FIRE INSERTS

FIELD OF THE INVENTION

The present invention relates generally to a circulating chamber for fireplaces but more particularly to an adjustable circulating chamber for fire inserts.

BACKGROUND OF THE INVENTION

Fireplace inserts are wood or gas stoves that incorporate a circulating chamber installed inside the fire chamber of a masonry fireplace to make the fireplace more efficient. The circulating chamber is an integral part of the insert as it enhances the flow of heat.

As there is a variation in the sizes of masonry fireplaces, manufacturers of fireplace inserts fabricate them with small circulating chambers so as to fit all sizes. This reduction in dimension restricts air circulation and efficiency besides being more complicated to install and requiring strong circulating blowers which run on electricity.

There hence exists a need for an easier to install, larger and more efficient circulating chamber for a fireplace insert.

SUMMARY OF THE INVENTION

In view of the foregoing disadvantages inherent in the known devices now present in the prior art, the present invention, which will be described subsequently in greater detail, is to provide objects and advantages which are:

To provide for an adjustable circulating chamber whose width and the height is adjusted to the size of the existing fireplace, maximizing the circulating area.

Another advantage of this invention is that the top of the circulating chamber incorporates an adjustable opening to accommodate the flue pipe thereby allowing the flue pipe to be easily aligned with the flue collar of the insert and existing chimney of the masonry fireplace.

In order to do so, the invention comprises an adjustable circulating chamber for a fireplace insert having a rear wall including two linear sets of perforations forming two bendable side walls, and adapted such that the chamber can be adjusted to fit within fireplace inserts of differing dimensions and a top member including a linear set of perforations forming a flange portion thereon. The flange portion is adapted to be adjustably attached to the rear wall to thereby provide means to vary the height of the top member with respect to the rear wall. The top member further includes an oval-shaped opening therethrough and an adjustable flange member slidably mounted thereto and over the oval-shaped opening and having a circular opening therethrough, such that the oval-shaped opening and the adjustable flange member working together are adapted to receive, adjust, and fit fireplace flue pipes of differing dimensions to the fireplace insert.

The adjustable circulating chamber further comprises a pair of L-shaped brackets adapted to join the top member to the side walls of the rear wall, each of the L-shaped bracket includes a track portion along an edge thereon and adapted to slide along and retain therein a respective edge of the top member, and further includes sheet metal screws used to secure the L-shaped brackets to the top member and respective side walls when in place.

The top member is formed in the shape of a trapezoid and is adjustably attached to the rear wall via rivets passing through the flange portion and through an upper edge portion of the rear wall.

The adjustable flange portion is slidably and adjustably attached to the top member via wing nuts passing through holes in the adjustable flange portion and through elongated slots within the top member.

The rear wall, the top member, and L-shaped brackets are formed from sheet metal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
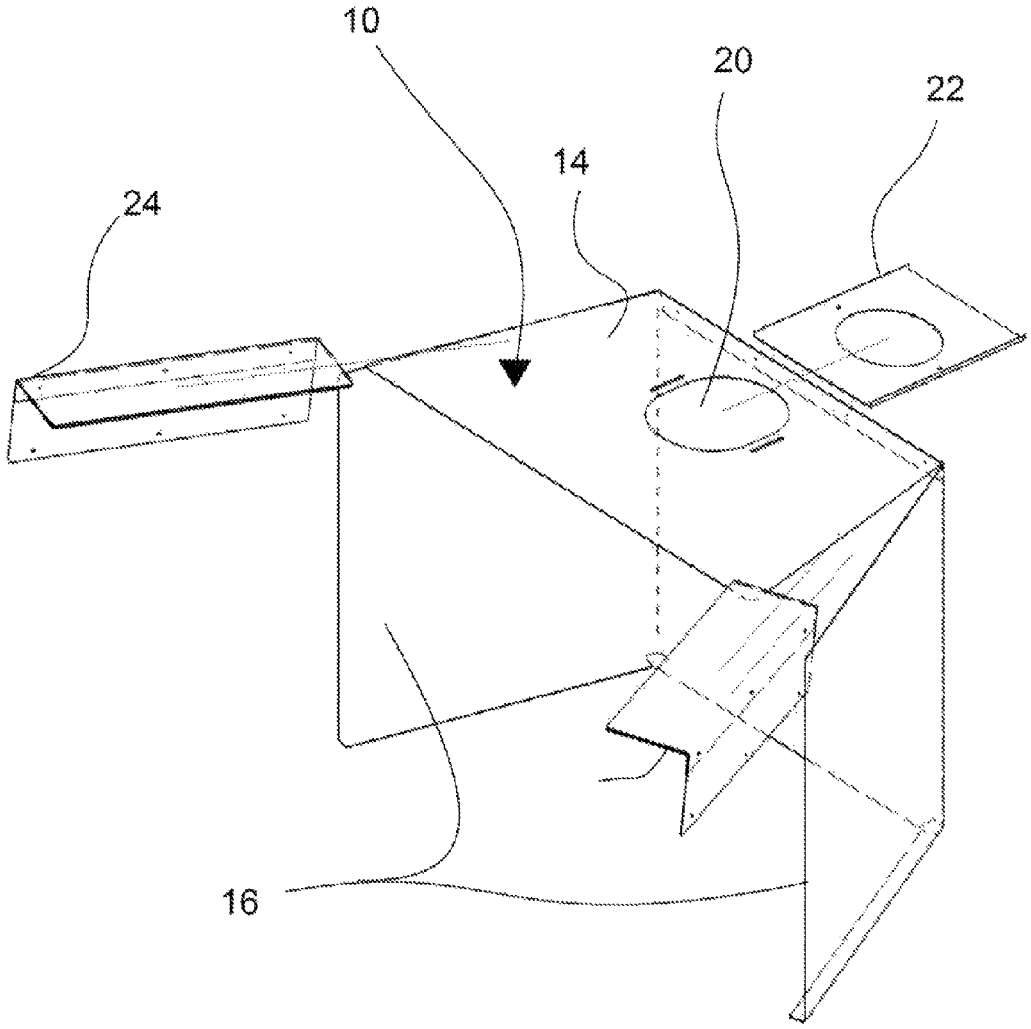
FIG. 1 Exploded view of the invention.
Figure 2:
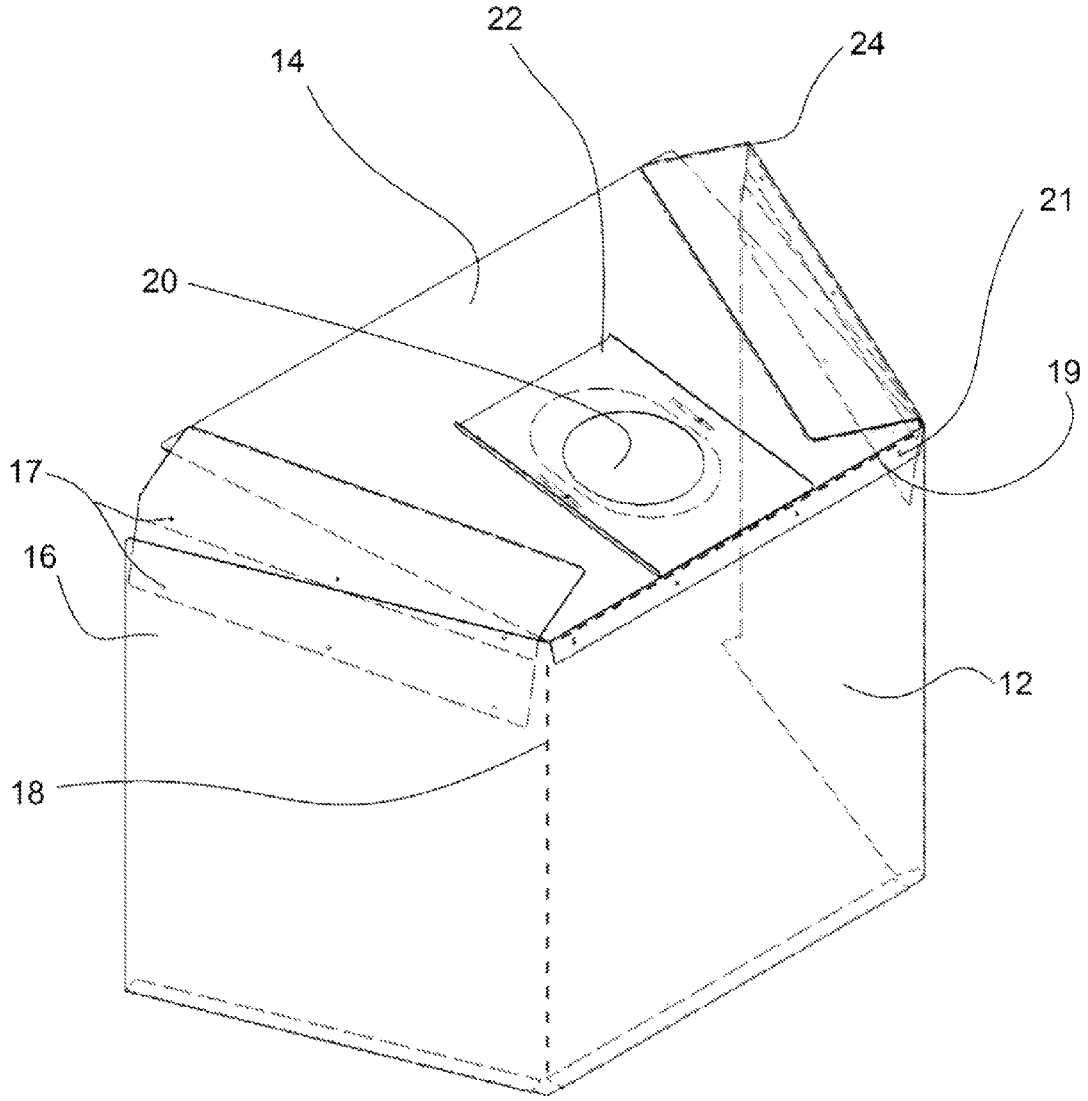
FIG. 2 isometric views of the side and rear of the invention.
Figure 3A:
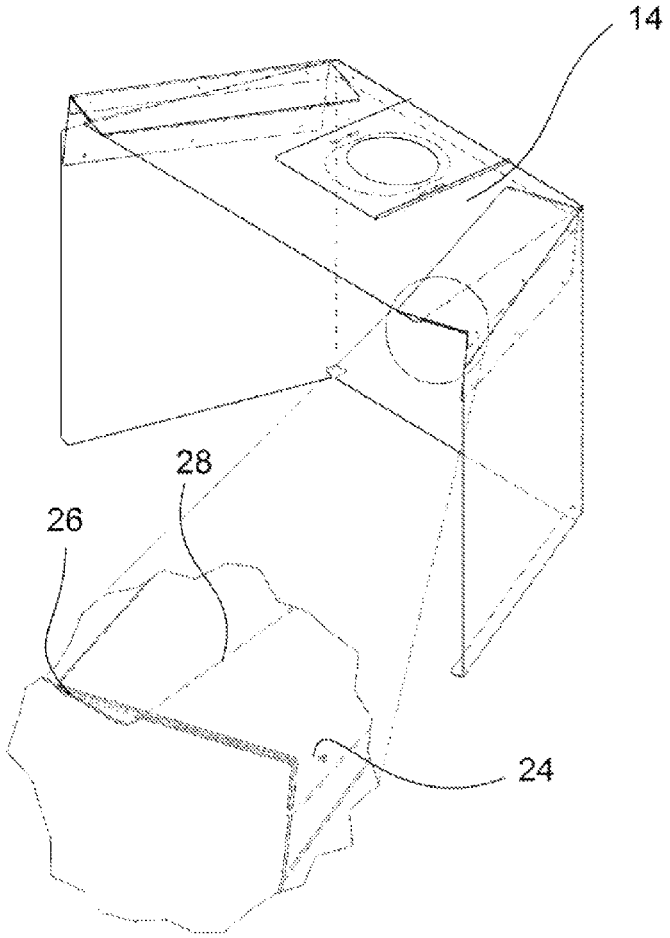
FIG. 3*a-b-c* Isometric views with close up view of the L-shaped bracket, top and side view of the invention.
Figure 3B:
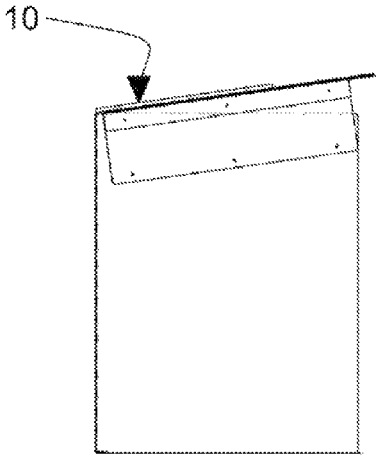
Figure 3C:
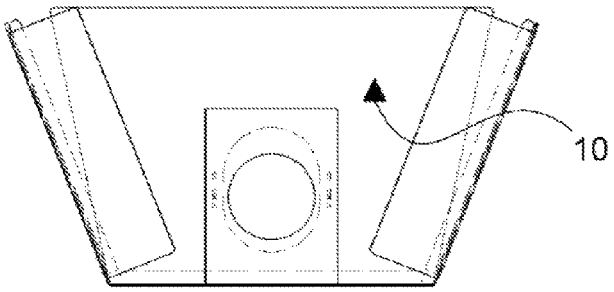

An adjustable circulating chamber (10) having a rear wall (12) with perforations (18) that allow an installer (not shown) to bend a pair of side walls (16) according to the size of the fireplace insert (not shown) it is being fitted within. A top member (14) in the shape of a trapezoid is attached by means of rivets (21) to the rear wall (12) and a flange portion with perforations (19) allows an installer to vary the height of the top (14) to fit the fireplace insert it is being installed within.

An oval opening (20) on the top (14) with an adjustable flange (22) having a circular opening that slides on the oval opening (20) allows adjustment for a round flue pipe (not shown) to be fitted to the fireplace insert. The adjustable flange (22) is affixed to the top (14) using pre installed wing nuts (not shown).

A pair of L-shaped brackets (24) is used to join the top (14) with the side walls (16) of the circulating chamber (10). Each L-shaped bracket (24) has a track member (26) allowing it to slide along the side edge (28) of the top (14) of the circulating chamber (10). The L-shaped brackets (24) are affixed to the top (14) and side walls (16) using sheet metal screws (17).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An adjustable circulating chamber for a fireplace insert, said adjustable circulating chamber comprising a rear wall including two linear sets of perforations forming two bendable side walls, and adapted such that said chamber can be adjusted to fit within fireplace inserts of differing dimensions; and a top member including a linear set of perforations forming a flange portion thereon, said flange portion adapted to be adjustably attached to said rear wall to thereby provide means to vary the height of said top member with respect to said rear wall, said top member further including an oval-shaped opening therethrough and an adjustable flange member slidably mounted thereto and over said oval-shaped opening and having a circular opening therethrough, such that said oval-shaped opening and said adjustable flange member working together are adapted to receive, adjust, and fit fireplace flue pipes of differing dimensions to said fireplace insert; a pair of L-shaped brackets adapted to join said top member to said side walls of said rear wall, each said L-shaped bracket including a track portion along an edge thereon and adapted to slide along and retain therein a respective edge of said top member, and further including sheet metal screws used to secure said L-shaped brackets to said top member and respective side walls when in place.

2. The adjustable circulating chamber of claim 1, wherein said top member is formed in the shape of a trapezoid.

3. The adjustable circulating chamber of claim 1, wherein said top member is adjustably attached to said rear wall via rivets passing through said flange portion and through an upper edge portion of said rear wall.

4. The adjustable circulating chamber of claim 1, wherein said adjustable flange portion is slidably and adjustably attached to said top member via wing nuts passing through holes in said adjustable flange portion and through elongated slots within said top member.

5. The adjustable circulating chamber of claim 1, wherein said rear wall and said top member are formed from sheet metal.

6. The adjustable circulating chamber of claim 1, wherein said L-shaped brackets are formed from sheet metal.

* * * * *